US010231528B2

(12) United States Patent
Corsi et al.

(10) Patent No.: US 10,231,528 B2
(45) Date of Patent: Mar. 19, 2019

(54) APPARATUS FOR HOLDING COSMETICS

(71) Applicants: Steve Corsi, Los Angeles, CA (US); Jacky Gunter, Westlake Village, CA (US); Angela Munoz, Burbank, CA (US); Kristen O'Connell, Woodlands Hills, CA (US)

(72) Inventors: Steve Corsi, Los Angeles, CA (US); Jacky Gunter, Westlake Village, CA (US); Angela Munoz, Burbank, CA (US); Kristen O'Connell, Woodlands Hills, CA (US)

(73) Assignee: THE ROBERTS CONTAINER CORP., Chatsworth, CA (US)

( * ) Notice: Subject to any disclaimer, the term of this patent is extended or adjusted under 35 U.S.C. 154(b) by 115 days.

(21) Appl. No.: 15/257,911

(22) Filed: Sep. 7, 2016

(65) Prior Publication Data

US 2017/0354236 A1 Dec. 14, 2017

Related U.S. Application Data

(60) Provisional application No. 62/215,026, filed on Sep. 6, 2015.

(51) Int. Cl.

| | |
|---|---|
| ***A45D 40/02*** | (2006.01) |
| ***A45D 40/12*** | (2006.01) |
| ***A45D 40/24*** | (2006.01) |

(52) U.S. Cl.

CPC ..... *A45D 40/02* (2013.01); *A45D 40/12* (2013.01); *A45D 40/24* (2013.01)

(58) Field of Classification Search

CPC ..... A45D 40/02; A45D 40/12; A45D 40/24; A45D 40/00; A45D 2040/00; A45D 2040/0025; A45D 2040/205; A45D 2040/207; B05C 17/01; B05C 17/0116

See application file for complete search history.

(56) References Cited

U.S. PATENT DOCUMENTS

| | | | | |
|---|---|---|---|---|
| 3,902,814 A * | 9/1975 | Cardia | A45D 40/02 401/66 |
| 5,833,382 A * | 11/1998 | Jenks | A45D 40/02 401/82 |
| 5,984,553 A * | 11/1999 | Piscopo | A45D 40/02 401/82 |
| 6,464,418 B1 * | 10/2002 | Visser | A45D 33/00 206/509 |
| 8,066,443 B2 * | 11/2011 | Thiebaut | A45D 40/02 401/82 |

* cited by examiner

*Primary Examiner* — David Walczak
(74) *Attorney, Agent, or Firm* — Law Office of David Hong

(57) ABSTRACT

There is a container that allows the movement of a cosmetic product in a holder within a sheath from a first position to a second position with the force translated from a button slider outside the sheath to underneath the product holder.

12 Claims, 7 Drawing Sheets

*Fig. 3*

DETAIL D

SCALE 1 : 2

SECTION A-A

APPARATUS FOR HOLDING COSMETICS

PRIORITY CLAIM

This application is a continuation in part of and claims the benefit of U.S. Provisional Patent Appl. No. 62/215,026, filed Sep. 6, 2015, which is incorporated by reference in entirety.

BACKGROUND OF THE INVENTION

1. Field of the Invention

This invention relates to containers for cosmetics, pharmaceuticals, food or other consumable matter.

2. Description of Related Art

Prior to the present invention, there has always been a need to have containers to hold cosmetics, foundation and make-up (solid, powder and liquid form) in an easy to carry, organize and open/close manner.

Prior devices used too much material within the apparatus to move the material from a first elevation to a second elevation; wasted material is unacceptable when the cosmetic, pharmaceutical or other consumable matter is expensive, valuable or small in size or quantity. Other prior art devices like a stick of deodorant or lip balm require unused space within the apparatus for the base and screw lifting apparatus; this adds to a larger product.

With the enclosed invention, less material or matter is needed within the product holder or base; this invention provides volume savings of nearly thirty percent of material needed to be used with the apparatus or product holder. Further, this invention allows for a much smaller and compact container for cosmetics, pharmaceutical or other consumable products.

This invention also provides the ability for using different cross-sectional shapes of the bullet (round, oval, square, rectangular or non-uniform); this invention also allows for the linking of two apparatus for holding cosmetics, pharmaceutical or other consumable products.

From the preceding descriptions, it is apparent that the devices currently being used have significant disadvantages. Thus, important aspects of the technology used in the field of invention remain amenable to useful refinement.

SUMMARY OF THE INVENTION

An apparatus for holding a matter (cosmetics, pharmaceutical, food or other consumable matter) comprising: a product holder with a first product holder end for holding the cosmetics matter and a second product holder end; the product holder lies and fits slidably within a sheath; the sheath is hollow and has open sheath ends; the sheath has a slot, groove or channel that runs along a longitudinal axis of the sheath; a button slider slidably engages the sheath; the button slider has a first button slider end and a second button slider end; the first button slider end and the second button slider end lie perpendicularly with respect to one another; the second button slider end is perpendicular to the longitudinal axis of the sheath; the second button slider end engages the product holder; the first button slider end slidably engages the sheath; wherein the button slider allows a consumer to apply a force along the longitudinal axis of the sheath; the force is translated from the first button slider end to the second button slider end and to the product holder along the longitudinal axis of the sheath so that the product holder and the cosmetics matter can be moved from a first elevation to a second elevation.

A top cap or cover can fit over the sheath, product holder and button slider; a base or a foundation can engage the sheath; the second button slider end can have at least one flexible prong, which engages the channel on the sheath; the product holder can have at least one rib; the product holder can have a first cavity for engaging the first button slider end; the product holder can have a second cavity for engaging the second button holder end; a connector base can connect more than one apparatus together.

A package apparatus or a package for dispensing a cosmetic product comprising: a product holder with a first open product holder end and a second closed product holder end; the second closed product holder end having a centrally disposed engagement area and a length; a sheath with two open sheath ends, at least one sheath sidewall and a slotted channel on the least one sheath sidewall; a sliding button, which slidably engages the sheath along the slotted channel; the sliding button having an arm that contacts and supports the length of the second closed product holder end; the arm of the sliding button connects to the centrally disposed engagement area on the second closed product holder end; whereby when a user applies a force to the sliding button, the force is translated to the second closed product holder end and allows the product holder to move from a first elevation to a second elevation; the centrally disposed engagement area can be a loop (or a hole or a ring), and the arm of the sliding button fits within the loop; the engagement area can mimic the cross-sectional shape of the arm.

The arm can be firm or rigid and contacts the entire length of the second closed product holder end; the sheath has an inside sheath surface, which has provides varying resistance to movement of the sliding button at a first sheath location and at a second sheath location; a cap can cover the sheath, the product holder and the sliding button; a base can securely engage the sheath; a base is a connector that can engage and connect the sheath of a first package and a second package, whereby the first package and the second package are connected.

This invention relates to a container that allows the movement of a cosmetic, pharmaceutical or consumable product in a product holder within a sheath from a first position or elevation to a second position or elevation with the force translated from a button slider outside the sheath to underneath the product holder; the product holder has a first end (for holding the cosmetics matter) and a second end for engaging a button slider; the button slider allows the user to apply a force along the longitudinal axis of the sheath; this force is translated to the second end of the button slider to either lift or to lower the product holder with respect to the sheath.

This invention allows for a much smaller and compact container and using different cross-sectional shapes of the bullet for cosmetics, pharmaceutical or other consumable products.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LISTING

Figure 1:
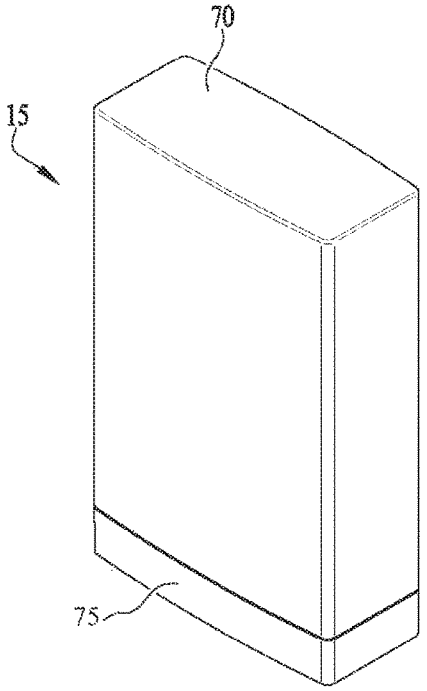
FIG. 1 shows one perspective view of one preferred embodiment of an apparatus for holding cosmetics (a single apparatus, assembled and closed with the cap cover).

15 apparatus for holding a cosmetics matter
20 product holder
25 first product holder end for holding the cosmetics matter and
30 second product holder end;
35 sheath;
40, 45 open sheath ends;
50 channel that runs along a longitudinal axis of the sheath;
55 button slider slidably engages the sheath;
60 first button slider end
65 second button slider end;
70 top cap fits over the sheath, product holder and button slider;
75 base engages the sheath.
80 flexible prong on the second button slider end, which engages the channel on the sheath.
85 track portion on the second button slider end, which engages the channel on the sheath
90 rib on the inside surface of the product holder
95 first cavity on the product holder for engaging the first button slider end
100 second cavity on the product holder for engaging the second button holder end
105 connector base connects more than one apparatus together
110 arm of the sliding button
115 engagement area on the product holder
120 loop of the engagement area of the product holder
125 length of the second closed product holder end
130 first location within the inside surface of the sheath
135 second location within the inside surface of the sheath

DESCRIPTION OF THE PREFERRED EMBODIMENTS

FIGS. 1-10 show a preferred embodiment of an apparatus for holding cosmetics, pharmaceutical or consumable matter (hereinafter "matter"). This apparatus has a product holder or cup, which engages a button slider and a sheath; the apparatus is enclosed within a cap and a base or base connector; a connector can attach two or more apparatus containers together.

Product Holder, Sheath and Button Slider:

As shown in FIG. 1-10, there is an apparatus for holding a cosmetics, pharmaceutical or other consumable matter comprising: a product holder with a first product holder end for holding the cosmetics matter and a second product holder end; the product holder lies and fits slidably within a sheath; the sheath is hollow and has open sheath ends; the sheath has a channel or slot or groove that runs along a longitudinal axis of the sheath; a button slider slidably engages the sheath; the button slider has a first button slider end and a second button slider end; the first button slider end and the second button slider end lie perpendicularly with respect to one another; the second button slider end is perpendicular to the longitudinal axis of the sheath; the second button slider end engages the product holder; the first button slider end slidably engages the sheath; a consumer or user can apply a force or a pressure to the first button slider end; wherein the button slider allows the consumer to apply the pressure or the force along the longitudinal axis of the sheath; the force is translated from the first button slider end to the second button slider end and to the product holder along the longitudinal axis of the sheath so that the product holder and the enclosed product can be moved from a first elevation or first position to a second elevation or second position.

Product Holder, Sheath and Button Slider:

The product holder has a first end for holding the matter and a second end for engaging a button slider. The product holder lies and fits slidably within a sheath; the sheath is hollow and can mimic the shape of the product holder, but is preferably longer to be able to hold the cosmetic material; the sheath has open ends.

Figure 3:
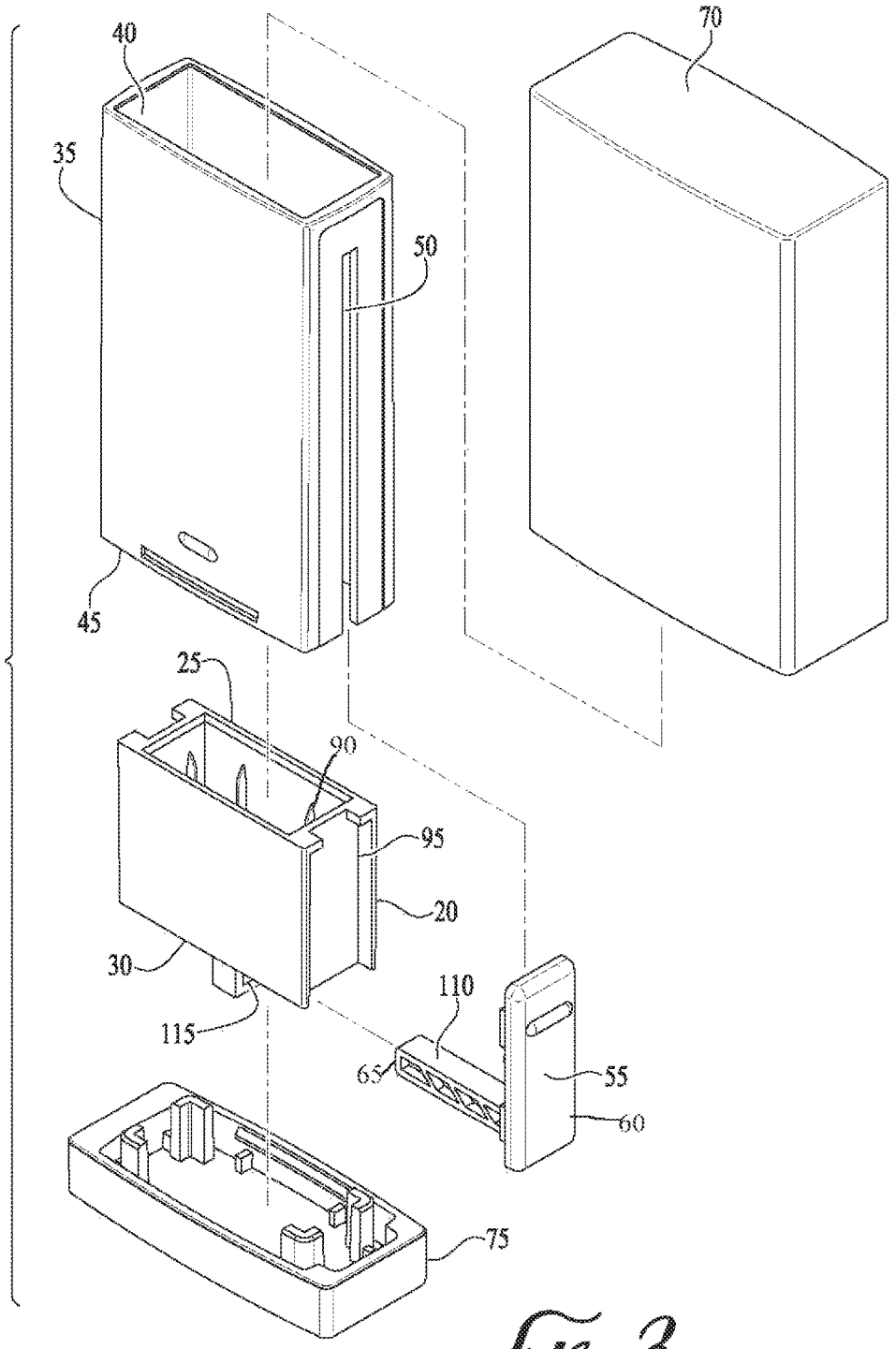
FIG. 3 and FIG. 4 show other exploded views of the embodiment of FIG. 1 with the following elements: cap cover, sheath, product holder, button slider and base.
Figure 4:
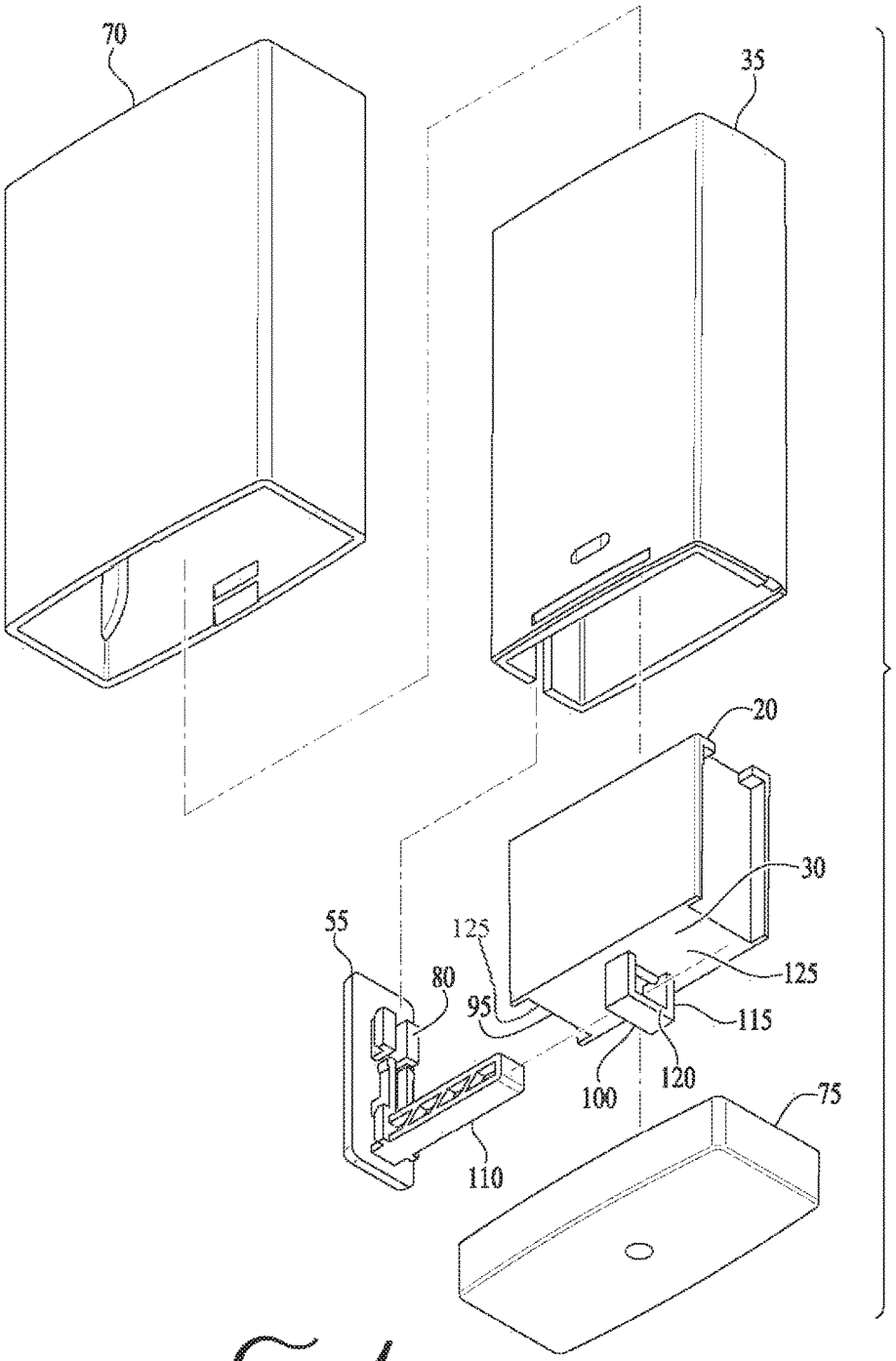
Figure 5:
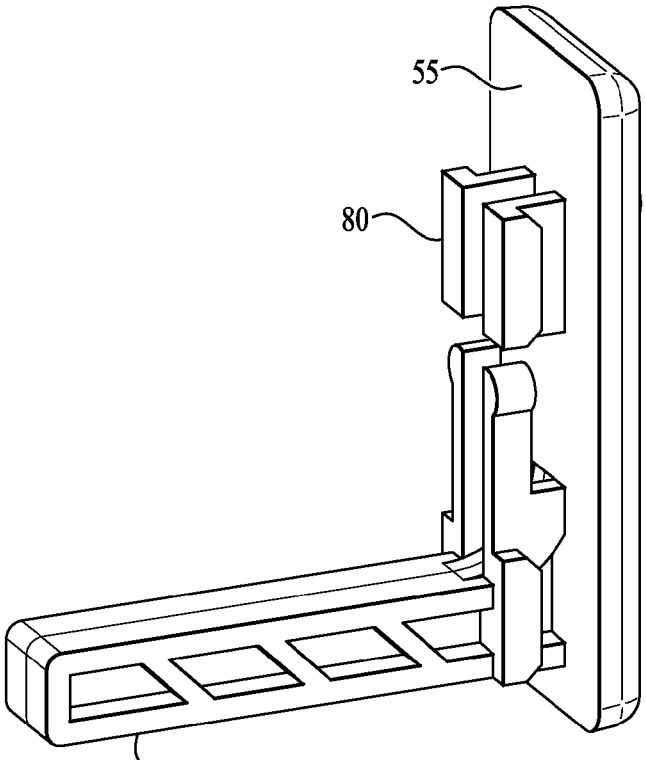
FIG. 5 and FIG. 6 show different embodiments of the button slider.
Figure 6:
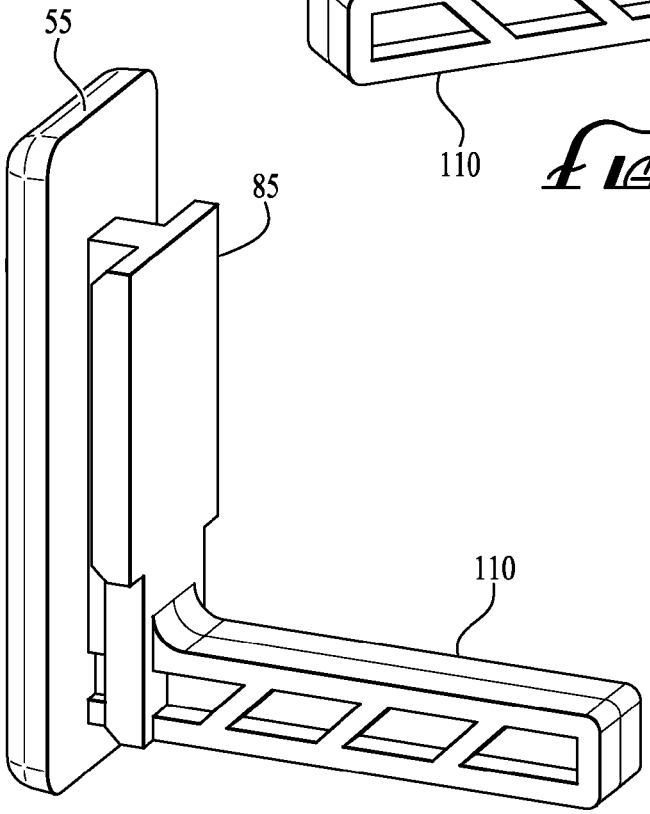
Figure 7B:
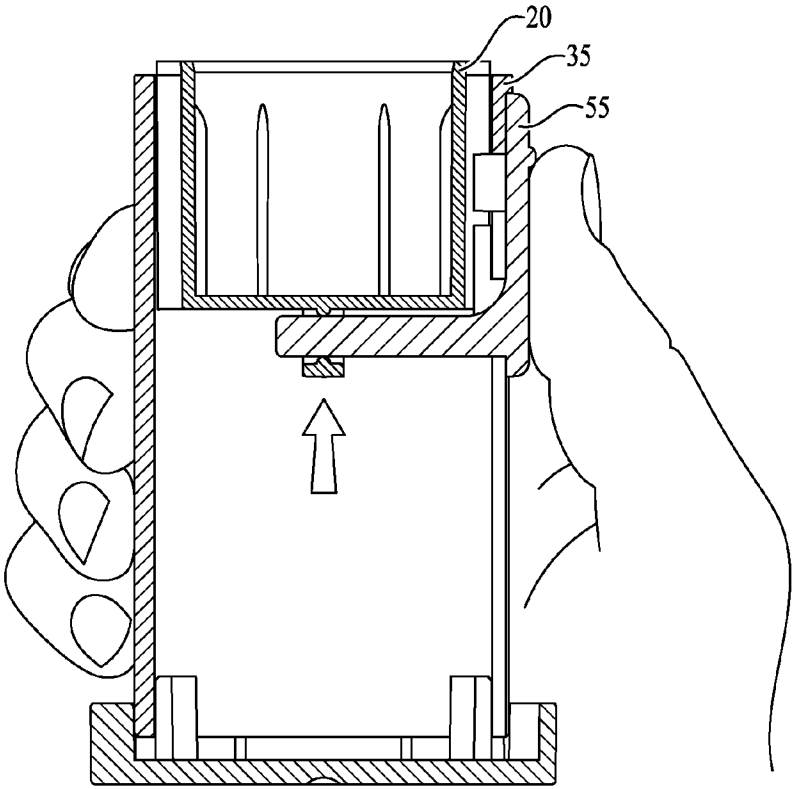
FIG. 7B shows a cross-sectional view of the embodiment in FIG. 2, in a second position or a second elevation.
Figure 7A:
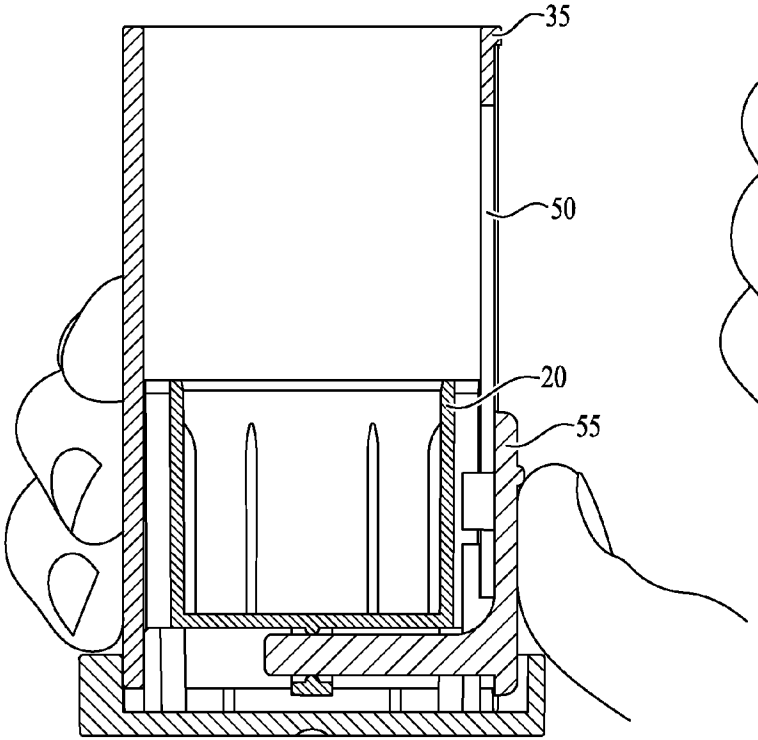
FIG. 7A shows a cross-sectional view of the embodiment in FIG. 2, in a first position or a first elevation.

The second end of the product holder engages the button slider; this second end of the product holder can have an engagement area, loop, groove, slot or shelf, wherein the button slider can connect and engage. FIGS. 3 and 4 show that this engagement area on the second end of the product area mimics the shape of the portion of the arm or the button slider end; this can be described as a male/female connection.

The button slider has a first button slider end and a second button slider end; the first and the second button slider ends lie perpendicular with respect to one another; the second end of the button slider is also perpendicular to the longitudinal axis of the sheath. The button slider allows the user to apply a force along the longitudinal axis of the sheath; this force is translated to the second end of the button slider to either lift or to lower the product holder with respect to the sheath.

The second end of the button slider can have a length that extends substantially, partially or the entire length of the product holder to help provide enough surface area of contact to apply a consistent force to the product holder when the user or the consumer applies an upward or downward force to the first end of the button slider.

The button slider engages one end of the sheath that can have a slot, a channel or a groove to allow for a measured or controlled movement of the product holder up and down the length of the sheath. The L-shape of the button slider apparatus is important (but not intended to be limiting) because it applies force to the center of the product holder. Other embodiments may allow for the slot or groove on the sheath to have graduated teeth.

Figure 2:
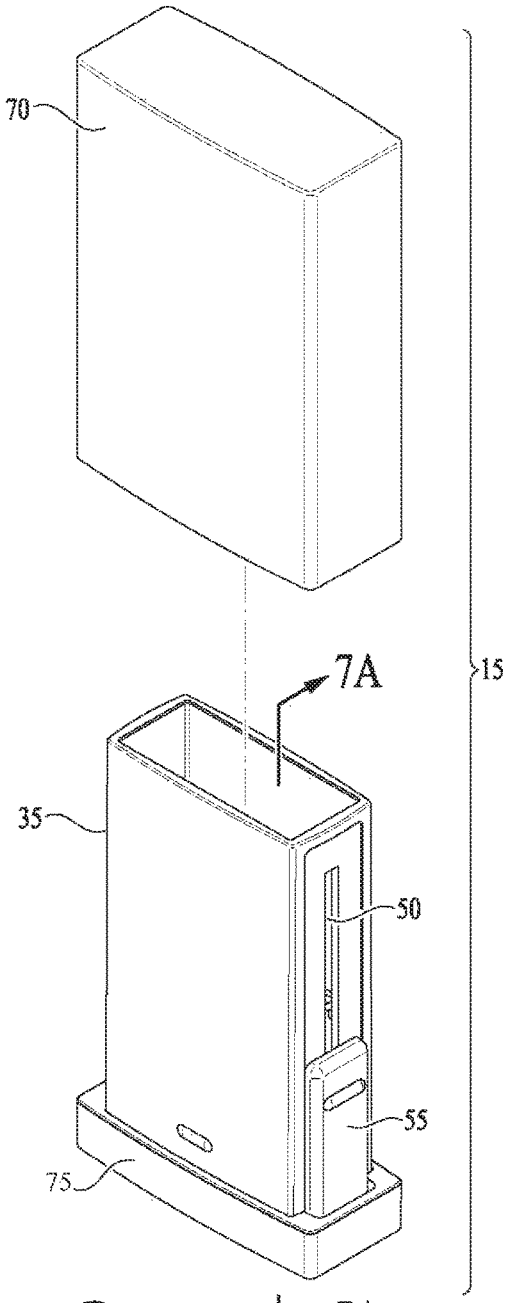
FIG. 2 shows an exploded view of the embodiment of FIG. 1 with the cap cover removed.

An end cap can envelop the assembly of the product holder, button slider and the sheath; a top cap fits over the sheath, product holder and button slider assembly. The end cap or a foundation can have boss structures or guides to engage the sheath, product holder or button slider assembly. Together, the end cap and the top cap (or cover) completely cover the assembled apparatus as shown in FIGS. 1 and 2.

Figure 8:
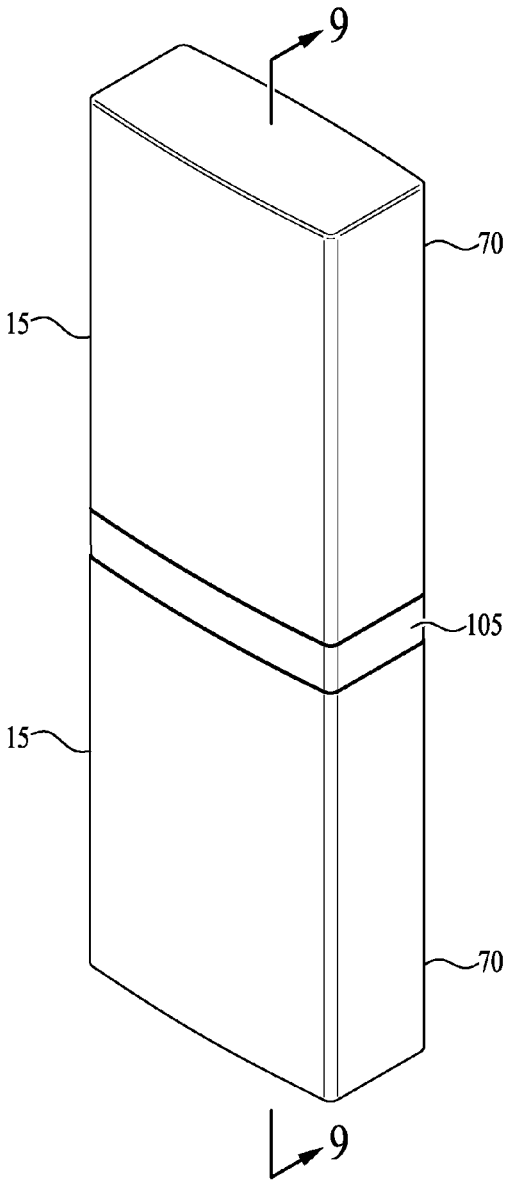
FIG. 8 shows two apparatus connected at an end.
Figure 9:
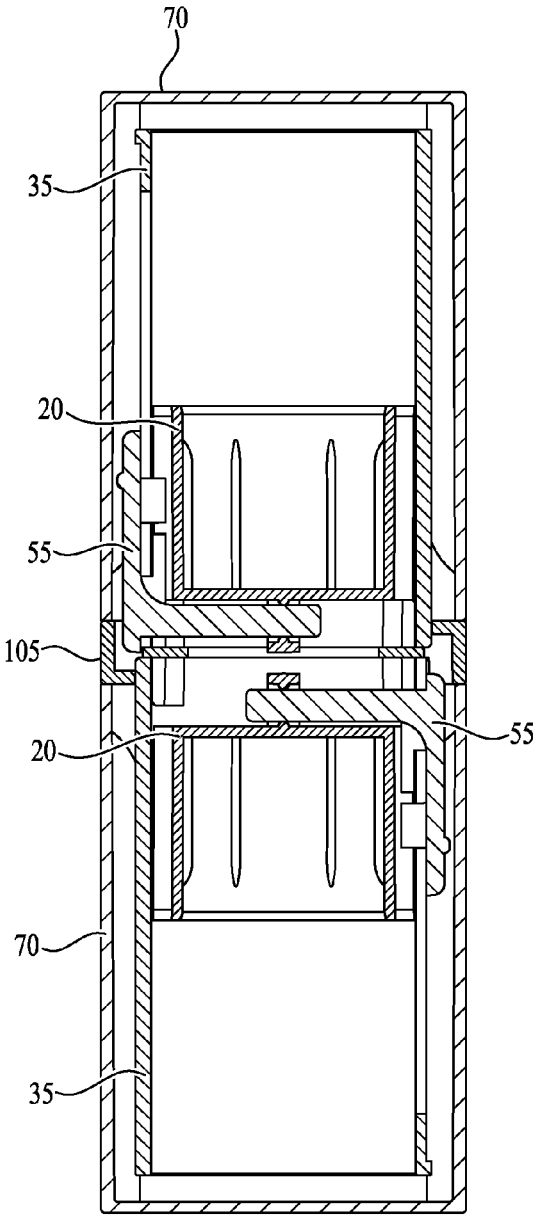
FIG. 9 shows a cross-sectional view of the embodiment of FIG. 8.

FIGS. 8 and 9 show another embodiment of the invention, wherein multiple apparatus are joined together at the end cap area. This connector end cap allows for more than one apparatus to be connected at the end cap end so that a consumer can have different types or colors of cosmetics within one easy to use product.

FIG. 4 shows another preferred version of the button slider, wherein there are prongs, bosses or teeth, which flex back and forth over the sheath teeth to create a smoother sliding feedback with the slot or channel on the sheath.

It is possible that the button slider and the product holder or cup can be combined into one part; however, a combined button slider and product holder would work optimally in certain circumstances (small diameter cylindrical cups); it is less effective when a combined button slider and product holder are used with larger shapes; this is most likely due to an unbalanced sliding force, which can cause jamming of the apparatus.

For most applications, the connection between the button slider and the product holder should preferably be non-rigid (e.g., possibly attached by a living hinge) or allow for some flexion. Without being limiting, it is preferred that the apparatus to maintain its own center without an unbalanced force on one side (i.e., a rectangular footprint, when pushed from the short side).

Multiple Shapes for the Product Holder, Sheath or Bullet: This apparatus and mechanism for advancing the matter or product could be used with a variety of cup and sheath shapes, including square, triangle or even round shapes. In addition to products going opposite directions, the apparatus could have multiple cups going the same direction; for example we could have a single sheath with two product holders (each with its own product or matter) parallel to each other and a sliding button on each side.

Figure 10C:
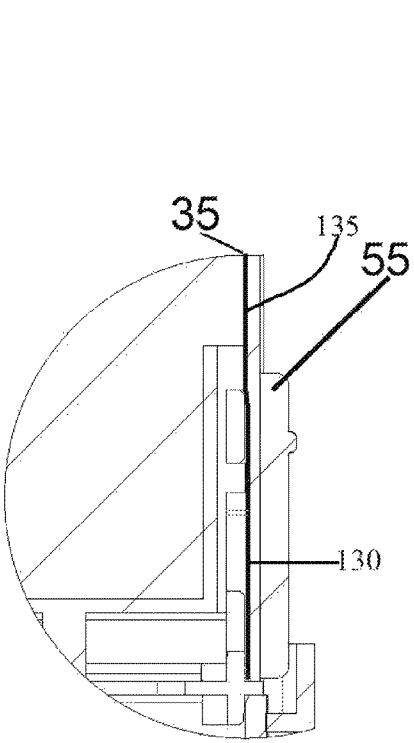
FIGS. 10A, 10B and 10C show view of another embodiment of the sheath with varying or different amounts of resistance to the button slider.
Figure 10B:
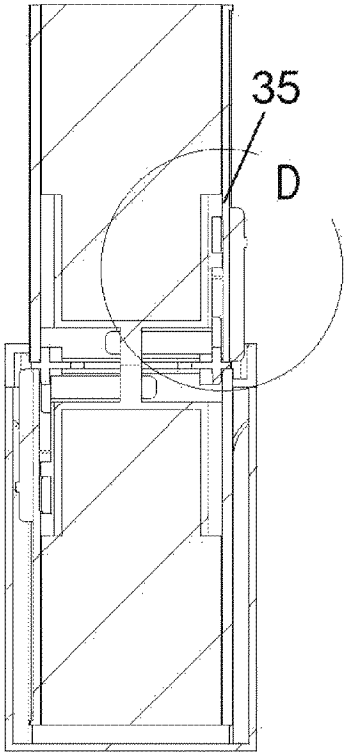
Figure 10A:
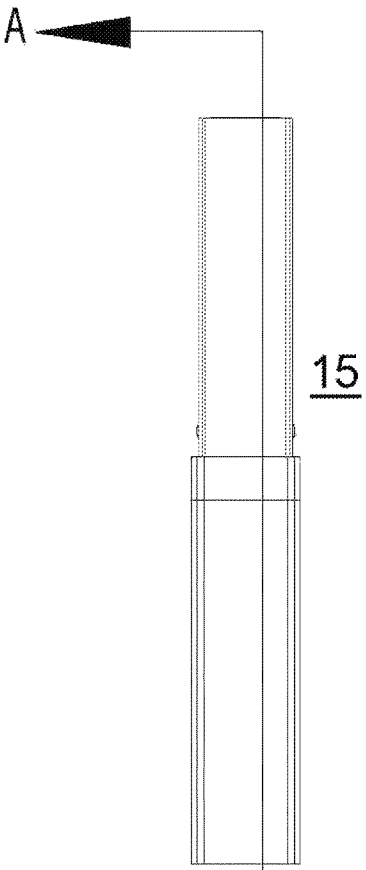

Sheath Friction Surface: As shown in FIGS. 10A, 10B and 10C, the inner or first surface of the sheath can also have another embodiment, namely a graduated width so that the lower portion of the slider has a different, wider or greater width than the middle or upper portions of the slider. As a result, when the consumer applies an initial upward force to the button slider, since there is less material in the first surface of the sheath and less friction or resistance, the button slider can more easily move the product holder up or from a first elevation to a second elevation.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the title, headings, terms and phrases used herein are not intended to limit the subject matter or scope; but rather, to provide an understandable description of the invention. The invention is composed of several sub-parts that serve a portion of the total functionality of the invention independently and contribute to system level functionality when combined with other parts of the invention.

The terms "a" or "an" are defined as "one" or "more than one." The term "plurality" is defined as two or more than two. The term "another" is defined as at least a second or more. The terms "including" and/or "having" are defined as "comprising" (i.e., open language). The term "coupled" is defined as "connected," although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

Incorporation by Reference: All publications, patents, and patent applications mentioned in this specification are herein incorporated by reference to the same extent as if each individual publication, patent, or patent application was specifically and individually indicated to be incorporated by reference: U.S. Pat. No. 8,784,854 Choi; U.S. Pat. No. 6,060,041 Candeau; U.S. Pat. No. 6,391,233 Otani; US Patent Publ. No. 2003/0216483 Hermann.

We claim:

1. An apparatus for holding a cosmetics matter comprising:

a product holder with a first product holder end for holding the cosmetics matter and a second product holder end;

the product holder lies and fits slidably within a sheath;

the sheath is hollow and has open sheath ends;

the sheath has a channel that runs along a longitudinal axis of the sheath;

a button slider slidably engages the sheath;

the button slider has a first button slider end and a second button slider end;

the first button slider end and the second button slider end lie perpendicularly with respect to one another;

the second button slider end is perpendicular to the longitudinal axis of the sheath;

the second button slider end engages the product holder;

the first button slider end slidably engages the sheath;

the sheath has an inside sheath surface, which provides varying resistance to movement of the sliding button at a first sheath location and at a second sheath location;

wherein the button slider allows a consumer to apply a force along the longitudinal axis of the sheath; the force is translated from the first button slider end to the second button slider end and to the product holder along the longitudinal axis of the sheath so that the product holder can be moved from a first elevation to a second elevation.

2. The apparatus of claim 1, wherein a top cap fits over the sheath, product holder and button slider; and a base engages the sheath.

3. The apparatus of claim 1, wherein the first button slider end has at least one flexible prong, which engages the channel on the sheath.

4. The apparatus of claim 1, wherein the first button slider end has two flexible prongs, which engage the channel on the sheath.

5. The apparatus of claim 1, wherein the product holder has at least one rib.

6. The apparatus of claim 1, wherein a connector base connects more than one apparatus together.

7. A package for dispensing a cosmetic product comprising:

a product holder with a first open product holder end and a second closed product holder end;

the second closed product holder end having a centrally disposed engagement area and a length;

a sheath with two open sheath ends, at least one sheath sidewall and a slotted channel on the least one sheath sidewall;

a sliding button, which slidably engages the sheath along the slotted channel;

the sliding button having an arm that contacts and supports the length of the second closed product holder end;

the arm of the sliding button connects to the centrally disposed engagement area on the second closed product holder end;

the sheath has an inside sheath surface, which provides varying resistance to movement of the sliding button at a first sheath location and at a second sheath location;

whereby when a user applies a force to the sliding button, the force is translated to the second closed product holder end and allows the product holder to move from a first elevation to a second elevation.

8. The package of claim 7, wherein the centrally disposed engagement area is a loop, and the arm of the sliding button fits within the loop.

9. The package of claim 7, wherein the arm is rigid and contacts the entire length of the second closed product holder end.

10. The package of claim 7, wherein a cap covers the sheath, the product holder and the sliding button.

11. The package of claim 7, wherein a base securely engages the sheath.

12. The package of claim 7, wherein a base is a connector that can engage and connect the sheath of a first package and a second package, whereby the first package and the second package are connected.

* * * * *